US008402893B2

(12) United States Patent
Van Rooijen et al.

(10) Patent No.: US 8,402,893 B2
(45) Date of Patent: Mar. 26, 2013

(54) COMBUSTION CHAMBER FOR LAUNCHING FIREWORKS PROJECTILES

(75) Inventors: Murk Pieter Van Rooijen, Stellendam (NL); Rutger Webb, Rotterdam (NL)

(73) Assignee: Clearspark, LLC, Glendale, CA (US)

( * ) Notice: Subject to any disclaimer, the term of this patent is extended or adjusted under 35 U.S.C. 154(b) by 296 days.

(21) Appl. No.: 12/528,252

(22) PCT Filed: Feb. 22, 2008

(86) PCT No.: PCT/NL2008/050107

§ 371 (c)(1),
(2), (4) Date: Feb. 5, 2010

(87) PCT Pub. No.: WO2008/103047

PCT Pub. Date: Aug. 28, 2008

(65) Prior Publication Data

US 2010/0139516 A1 Jun. 10, 2010

(30) Foreign Application Priority Data

Feb. 23, 2007 (EP) ..... 07102998

(51) Int. Cl.
*F42B 4/00* (2006.01)

(52) U.S. Cl. ..... 102/335

(58) Field of Classification Search ..... 102/335, 102/347, 357, 349, 351, 361, 343, 336, 523, 102/293, 532, 440, 328, 326, 325, 323; 89/1.8, 89/1.81, 1.816–1.818, 31, 30, 4.05
See application file for complete search history.

(56) References Cited

U.S. PATENT DOCUMENTS

| | | | | | |
|---|---|---|---|---|---|
| 2,790,389 | A | * | 4/1957 | Ackerman, Jr. | 102/335 |
| 3,335,780 | A | * | 8/1967 | Klaubert | 431/91 |
| 3,719,145 | A | * | 3/1973 | Brown et al. | 102/351 |
| 3,958,949 | A | * | 5/1976 | Plantif et al. | 422/166 |
| 4,406,227 | A | * | 9/1983 | Beeker et al. | 102/505 |
| 4,539,910 | A | * | 9/1985 | Stevens | 102/349 |
| 4,666,398 | A | * | 5/1987 | Kumazawa et al. | 431/201 |
| 4,962,689 | A | * | 10/1990 | Phan et al. | 89/1.703 |
| 5,282,455 | A | | 2/1994 | Adamson et al. | |

(Continued)

FOREIGN PATENT DOCUMENTS

| | | | |
|---|---|---|---|
| FR | 1354703 | A | 4/1963 |
| FR | 1 354 703 | A | 3/1964 |

(Continued)

OTHER PUBLICATIONS

International Search Report dated Jun. 24, 2008, for PCT/NL2008/050107.

(Continued)

*Primary Examiner* — Michael Carone
*Assistant Examiner* — Reginald Tillman, Jr.
(74) *Attorney, Agent, or Firm* — Marsh Fischmann & Breyfogle, LLP; Kent A. Lembke

(57) ABSTRACT

The invention provides a combustion chamber (3) for launching a fireworks projectile which comprises a container (4) having top wall, bottom and side walls, wherein the top wall which comprises venting holes (1). The invention further provides a launching system', a method for launching a fireworks projectile, and a kit of parts comprising the combustion chamber (3) or launching system in accordance with the present invention and a propellant charge (7) for use in the combustion chamber (3).

27 Claims, 1 Drawing Sheet

U.S. PATENT DOCUMENTS

| | | | | |
|---|---|---|---|---|
| 5,339,741 | A | 8/1994 | Craven et al. | |
| 5,526,750 | A | 6/1996 | Poor et al. | |
| 5,627,338 | A | 5/1997 | Poor et al. | |
| 5,672,842 | A | 9/1997 | Brion et al. | |
| 5,983,801 | A * | 11/1999 | Brunn | 102/334 |
| 6,237,950 | B1 * | 5/2001 | Cook et al. | 280/736 |
| 6,393,990 | B1 * | 5/2002 | Fagan | 102/342 |
| 6,659,012 | B1 * | 12/2003 | Grassl et al. | 102/336 |
| 7,104,199 | B2 | 9/2006 | Walker et al. | |
| 2004/0159259 | A1 | 8/2004 | Walker et al. | |

FOREIGN PATENT DOCUMENTS

| | | | |
|---|---|---|---|
| FR | 2492090 | A1 | 4/1982 |

OTHER PUBLICATIONS

European Search Report, EP1962047 A1, dated Aug. 3, 2007, place of search.

Office Action dated Feb. 28, 2012 and English Translation for JP Patent Application No. 2009-550819.

Microfilm of Japanese Utility Model Application No. S61-153381 (Japanese Model Publication No. 63-61694) and English Translation.

CN Office Action mailed on Feb. 29, 2012 for CN Patent Application No. 200880005997.2 and English translation.

* cited by examiner

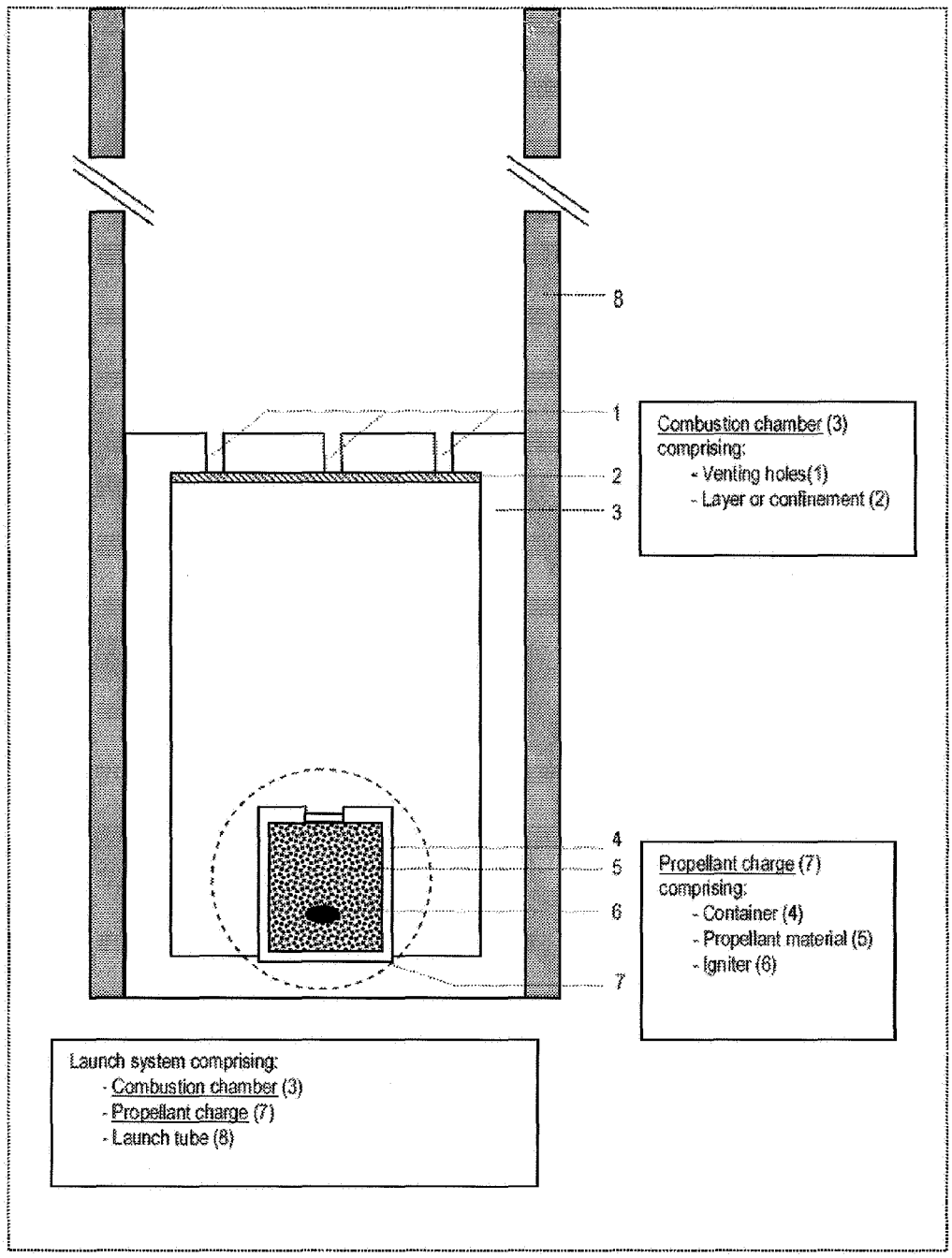
8
1
2
3
Combustion chamber (3)
comprising:
- Venting holes(1)
- Layer or confinement (2)
4
5
6
7
Propellant charge (7)
comprising:
- Container (4)
- Propellant material (5)
- Igniter (6)
Launch system comprising:
- Combustion chamber (3)
- Propellant charge (7)
- Launch tube (8)

COMBUSTION CHAMBER FOR LAUNCHING FIREWORKS PROJECTILES

FIELD OF THE INVENTION

The present invention relates to a combustion chamber, a launching system for launching a fireworks projectile, a method for launching a fireworks projectile, and a kit of parts comprising a launching system and a propellant charge.

BACKGROUND

Fireworks projectiles are a category of firework articles. Fireworks projectiles are usually launched from a reusable launch tube. The fireworks projectile is a container loaded with fireworks effects, "special effects" like stars, comets, hummers, whistles etc. Fireworks projectiles come in many different shapes and sizes. They are manufactured with a propellant charge that is called a "lift charge" and which is attached to the projectile. Normally, the lift charge consists of a pressed, granulated and sieved fraction of black powder. Black powder, or sometimes called gunpowder, is a mixture of potassium nitrate (KNO3), charcoal and sulphur. Such a black powder charge propels the projectile into the air. When the black powder is ignited it burns very rapidly, so-called explosive burning or deflagration. During the explosive burning hot gasses are produced that enable the projectile to be launched from the launch tube.

Fireworks projectiles are usually made with a time-fuse, which serve as a time-delay element for explosion of the fireworks effects in the air. The time-fuse is ignited by means of the heat generated by the black powder, and after some delay it ignites the fireworks-effects inside the projectile in question which is located at the other end of the time-fuse, usually when the projectile is, after its launch, at its highest point, the so called "apex".

A well-known characteristic of black powder is that it has a relatively high burn rate at low pressures.

A characteristic of fireworks projectiles and fireworks launch systems is that the fireworks projectiles may fit quite loosely inside the launch tubes. Hence, often there is a "clearance" between the projectile and the launch tube of a few millimetres or more. It is further observed that the launch tube is also typically made of relatively thin-walled materials, which also limit the maximum pressures that can be used. This combination of factors, i.e. high burn rate of black powder at atmospheric pressures, a clearance between the launch tube and the projectiles, and thin walls of the launch tubes, makes black powder the preferred propellant charge for fireworks projectiles.

The main problem of the currently available technology for launching fireworks projectiles is that black powder generates a lot of smoke as an undesired by-product when it burns. About half of the mass of black powder ends up as smoke, i.e. very small solid combustion products.

One possibility is the use of smokeless powder that is based on a nitrocellulose-based gun propellant material. However, smokeless powder needs a high pressure to ignite properly and burn rapidly. The simple replacement of black powder by a smokeless propellant material will fail to launch fireworks projectiles because pressures inside fireworks launch systems are too low to allow smokeless powders to ignite and burn properly. For instance, in U.S. Pat. No. 7,104,199 a system is described to launch fireworks shells or comets using a nitrocellulose propellant material. In said document it has been indicated that low temperature combustion of nitrocellulose provides sufficient force to propel solid pyrotechnic compositions from a launch tube to a desired apex, but that it lacks sufficient heat of combustion to ignite the compositions, their primes, or the delay fuses on aerial shells.

Other known techniques for launching fireworks projectiles involve techniques to employ compressed air. In this respect reference can, for example, be made to U.S. Pat. Nos. 5,627,338; 5,526,750; 5,339,741; and 5,282,455. The disadvantages of this system are, however, the high installation, operating and maintenance costs.

SUMMARY OF THE INVENTION

Object of the present invention is to provide a combustion chamber that adequately launches fireworks projectiles in a reliably and reproducibly manner, and that simultaneously provides a means of ignition for said fireworks projectiles.

Surprisingly, it has now been found that this can be realised when use is made of a combustion chamber having a top wall which comprises venting holes.

The purpose of the combustion chamber is to maintain a desired pressure, throughout the entire period of functioning, or period of combustion of the propellant, reliably and consistently. Consequently, this aspect of maintaining the pressure, allows the system to generate a desired quantity of hot gasses over a desired period of time, which can be used to reliably and consistently launch and ignite fireworks articles. Such a desired operation is realised by using the venting holes in accordance with the present invention.

The physical shape and dimensioning (length, diameter) of the venting holes can be optimized for the best performance of the launch system. The venting holes may be permanently open, which is the case in a preferred embodiment of the invention, or they may be in a "closed" position, in the initial phase of the ignition of the propellant material, whereas they open at a later phase of the ignition. This "closed" position can be achieved in several ways. For instance use can be made of a perforatable disk which is attached to the top wall of the combustion chamber of which the top wall contains a number of openings, or the venting holes can be openings in the top wall of the combustion chamber that are temporary closed by means of valves.

A perforatable disk (or "bursting foil") will have such physical dimensioning and material properties that it will burst at a preset pressure value. Alternatively, mechanical reusable pressure relief valves of a durable design, or disposable pressure relief valves, may be used, that temporary close the openings in the top wall of the combustion chamber in the initial phase of the ignition. In yet another embodiment of the present invention a combination of a perforatable disk and valves can be used.

Accordingly, the present invention relates to a combustion chamber for launching a fireworks projectile which comprises a container having top, bottom and side walls, wherein the top wall which comprises venting holes.

The combustion chamber in accordance with the present invention has the advantage that it establishes a reliable and consistent launch of fireworks articles, while at the same time igniting said fireworks articles.

The venting holes can be distributed over the top wall in various patterns.

Preferably, the venting holes are uniformly distributed over the top wall.

Preferably, a symmetrical pattern of venting holes is applied.

Preferably, the top wall comprises 4-10 venting holes.

Suitably, the venting holes have a diameter in the range of from 0.5-8 mm.

Preferably, the venting holes have a diameter in the range of from 2-4 mm.

Suitably, the container is made of steel, stainless steel, bronze, brass, iron, cast iron, aluminium, or any alloy thereof, a plastic, a (fibre reinforced) resin material, or any other material that can be used for producing a pressure-vessel. Preferably, the container is made of stainless steel.

Preferably, the shape of the combustion chamber in accordance with this invention has a cylindrical shape, but this is not a functional requirement. Those skilled in the art will understand that other shapes, such as a frustum of a cone may also suitably be used.

The overall exterior shape of the combustion chamber will depend on the method in which the propellant charge to be used will be loaded in the launching system. This loading may be, for example, take place via a side-loading door mechanism.

The combustion chamber may further comprise a safety valve, designed as a built-in safety component, which fails before the combustion chamber is damaged, in case of over-pressure. Designs of such safety valves are known to those skilled in the art.

Preferably, the combustion chamber according to the present invention is of such a construction and design that it withstands operational launching conditions pressures.

Suitably, the top wall can be in the form of a removable disk which comprises venting holes, which disk is in operation of the combustion chamber fixed to side wall of the combustion chamber.

The present invention also relates to a launching system for launching a fireworks projectile comprising a launch tube for holding and successively launching the fireworks projectile and a combustion chamber in accordance with the present invention in which a propellant charge can be loaded.

Suitably, and in particularly when the propellant charge as such does not comprise an igniter, the launch system in accordance with the present invention further comprises an igniter which can be brought in the proximity of or in contact with the propellant material contained in the propellant charge when said propellant charge has been loaded in the combustion chamber. In another embodiment of the present invention, the igniter may be placed before the propellant charge has been loaded Preferably, the launch tube is mounted over the top wall of the combustion chamber, or alternatively the top wall of the combustion chamber is connected to the launch tube.

The present invention further relates to a method for launching a fireworks projectile comprising loading a propellant charge into the combustion chamber of the launching system as defined hereinabove and closing the combustion chamber, loading the fireworks projectile into the launch tube, and igniting the propellant material contained in the propellant charge once the charge and projectile have been loaded into respectively the launch tube and combustion chamber, whereafter the fireworks projectile will be launched and ignited from the launching system.

Preferably, in the present method use is made of a safety membrane which is arranged in between the top wall and the propellant charge to prevent an over-pressure in the combustion chamber.

In addition, the present invention also relates to a kit of parts comprising a launching system or combustion chamber as defined hereinabove and a propellant charge for use in the combustion chamber.

The purpose of the propellant charge is to generate the desired quantity of hot combustion gases; thereby presenting the desired quantity of force (or impulse) to propel or launch typical fireworks articles with the desired muzzle velocity, while simultaneously igniting said article.

The propellant charge to be used in accordance with the present invention comprises a propellant material which is known as a "propellant", such as for example, but not limited to, "single base propellant", or a "double base propellant". The propellant charge may further comprises a container, the purpose of which is to ensure that there is the desired amount of initial pressure to ensure proper ignition of said propellant material, whilst simultaneously allowing a practical form of packaging for said propellant material that can be handled under operational circumstances. Alternatively the container can be a cylindrical or spherical package (e.g. a disposable cup, bag, etc).

Suitably, the propellant charge comprises an igniter, preferably an electrical igniter of the types that are typically used in the field of application of fireworks, allowing the launching system to be activated remotely with very accurate timings, consequently permitting choreographing fireworks shows to music. In alternative embodiments of the present invention use can be made of a traditional fuse such a chemical time-delay fuse, including but not limited to a safety fuse, a Visco fuse, a black match fuse, a quick fuse, an igniter cord, or a Thermolite.

Alternatively, the propellant charge may also comprise a quantity of loose propellant material powder which is placed inside of the combustion chamber. In such an embodiment, no use is made of a container. In that case the igniter may be physically placed in contact with, or in the near vicinity of the propellant material, at short notice before use.

Preferably, the propellant charge to be used comprises a container which contains a reduced smoke propellant material and which container comprises a closed layer or confinement of a solid material which covers a cross-section of the container and which is arranged in the upper part of the container, wherein the closed layer or confinement is at least partly perforatable or rupturable by the gas pressure generated when the propellant material is ignited.

In the context of the present invention a confinement is defined as a sufficient enclosure of the propellant which ensures that the propellant will ignite properly and burn rapidly until perforation or rupture of the layer or confinement Suitably, in the propellant charge to be used in accordance with the present invention, the layer or confinement of the solid material is attached to the inner or outer surface of one or more sides of the container.

In another attractive embodiment of the present invention, the layer or confinement of solid material in the container of the propellant charge forms an integrated part of one or more sides of the container.

Suitably, the one or more sides of the container are the top or bottom side of the container.

In yet another attractive embodiment of the present invention, the layer or confinement of solid material in the container of the propellant charge is arranged inside the container thereby forming two compartments in the container, whereby a first compartment contains a first portion of the propellant material and a second compartment contains a second portion of the propellant material, the first portion being smaller than the second portion, whereby the parts of the one or more sides of the container that forms together with the layer or confinement of the solid material the first compartment are perforatable or rupturable by the gas pressure generated when the propellant material is ignited.

In such an embodiment, the one or more sides of the container are preferably the top or bottom side of the container of the propellant charge.

In an attractive embodiment, the container of the propellant charge has a cylindrical shape, although also other forms can suitably be used, depending of course on the shape of the combustion chamber to be used to launch the fireworks projectile in question.

Preferably, the container of the propellant charge to be used in accordance with the present invention has the form of a cartridge, a pouch, a cup, a shell or a disk.

Preferably, the layer or confinement of solid material in the container of the propellant charge is symmetrically arranged over a cross-section of the container. This cross-section can be arranged along the horizontal axis of the container. However, the cross-section selected may also be arranged so as to define an angle of a particular degree with the vertical axis of the container Suitably, the layer or confinement of solid material covers a circular part of the cross-section of the cylindrical container of the propellant charge (e.g. a flat circular disk), although the layer or confinement can cover another part of the cross-section, for instance in the form of a square or a triangle, or any other suitable form.

Preferably, the layer or confinement of the solid material to be used in accordance with the present invention is in the form of a disk.

Preferably, substantially all of the propellant material is located at one side of the layer of solid material.

In a preferred embodiment of the present invention, the layer or confinement of solid material is connected to the inner surface of the container of the propellant charge, thereby forming the top side or bottom side of the container. A small amount of propellant material is allowed to be present between the inner surface of the container and the layer or confinement of the solid material.

Suitably, the layer or confinement of solid material has a thickness in the range of between 0.01-0.5 mm.

Suitably, the solid material of which the layer or confinement is made comprises plastic, paper or a metal. Preferably, the solid material comprises a material selected from the group consisting of aluminium, pressed cardboard, bronze, phosphor bronze, brass, steel or any alloy thereof, a plastics, resins, or materials that are suitable for a bursting-disk type application. More preferably, the solid material comprises one of the above-mentioned metals or alloys thereof. Most preferably, the solid material comprises aluminium.

Preferably, the propellant material to be used in accordance with the present invention is a powder or in the form of granules or flakes. More preferably, the propellant material is the form of small granules Suitably, the reduced smoke propellant material to be used according to the present invention is selected from the group consisting of gun propellants, a single base propellant material based on nitrocellulose, double base propellant material based on nitrocellulose and nitroglycerine, triple base propellant material based on nitrocellulose and additives, a low vulnerability gun propellant material (LOVA type), a composite propellant, pyrotechnic gas generating materials, airbag type propellant materials, and high nitrogen materials based propellant materials.

Preferably, the propellant material comprises a single base propellant or a double base gun propellant. More preferably the propellant material comprises a single base gun propellant material based on nitrocellulose as the main ingredient.

Suitably, the container of the propellant charge has the form of a cylinder, frustum of a cone, or a cone, where it can be produced as a cartridge, a pouch, a cup, a shell or a disk.

The propellant charge in accordance with the present invention may suitably further comprises an igniter which is in the proximity of or in contact with the propellant material.

Suitably, the container of the propellant charge is made of a material chosen from the group consisting of a plastic, paper or a metal. Preferably, the material of which the container is made is chosen from the group consisting of aluminium, bronze, brass, molded plastics, or steel. More preferably, the container is made of aluminium, plastic or steel.

At least part of the layer or confinement of solid material is perforatable or rupturable by the gas pressure generated when the propellant material is ignited. In a particular attractive embodiment of the present invention the layer of confinement of solid material is substantially completely, more preferably completely perforatable or rupturable by the gas pressure generated when the propellant material is ignited.

A major advantage of the present combustion chamber is that it establishes a reliable and reproducible ignition phase and that a full complete combustion of the smokeless powders can be realised because a high pressure can be generated. In this respect it is observed that a certain pressure is needed before any pressure may be released to start lifting the fireworks projectile, for instance fireworks shell, comet or mine.

Suitably, a safety system is applied between the top wall of the container and the propellant charge to prevent an overpressure in the combustion chamber.

It is further observed that the present invention is reliable in providing sufficient heat to ignite pyrotechnic compositions, primes and also untreated commercial time-fuses, suitable for display shells, comets and mines. The invention is reliable in providing propulsion force to shells, and it enables the successful launching of relatively heavy shells to normal altitudes.

The launch tube to be used in the launching system according to the present invention is suitably placed over a part of the combustion chamber, or alternatively the launch tube may be placed over the entire combustion chamber. The launch tube can suitably be mechanically fixed in place, so the system is strong enough to withstand the recoil-forces associated with the launch-phase of fireworks projectiles.

DETAILED DESCRIPTION OF THE FIGURE

In FIG. 1, an embodiment is schematically shown of a launching system in accordance of the present invention, which embodiment does not limit the scope of the present invention. The launching system comprises a combustion chamber (3), a propellant charge (7) and a launch tube (8).

The combustion chamber (3) is a strong pressure vessel made from steel that is designed to withstand high pressures. The combustion chamber (3) has several venting holes (1), from which gasses will be ejected into the launch tube. Said hot gasses will cause an acceleration of a firework projectile (or another pyrotechnic device), and simultaneously said hot gasses will ignite a time-fuse often present on firework projectiles (or equally well, it will ignite a comet directly on the priming or often it is capable to ignite the main comet composition used). The upper-section of combustion chamber (3) can also be perceived as a section for positioning fireworks projectiles, and ensures the proper relative position of for example time-fuse of a firework display shell in respect to the hot gasses exiting from the venting holes (1). Optionally, located at the relative position (2) indicated in FIG. 1, is a layer or confinement (a perforatable disk or foil). This is a layer or confinement that—when present—will perforate or rupture when the propellant material has been ignited.

In this particular embodiment the propellant charge (7) will be loaded as a cartridge inside the combustion chamber (3) and it is locked in place by a closing mechanism which is not shown. Propellant charge (7) contains propellant material (5) inside a container (4) and an electric igniter (6). Not shown in FIG. 1 is a safety feature: a safety membrane, designed to prevent over-pressurization of the combustion chamber.

The invention claimed is:

1. A combustion chamber for launching a fireworks projectile which comprises:

a container having top, bottom and side walls, the top wall comprising venting holes; and a perforatable disk positioned adjacent to the top wall closing the holes to gas flow from the container, wherein the perforatable disk is adapted to burst when a preset pressure is exceeded in the container to open the holes to vent gas out of the container and wherein the preset pressure corresponds to a pressure for an ignition stage for a propellant comprising a reduced smoke propellant material.

2. The combustion chamber according to claim 1, wherein the venting holes are uniformly distributed over the top wall.

3. The combustion chamber according to claim 1, wherein the top wall comprises 4-10 venting holes.

4. The combustion chamber according to claim 1, wherein the venting holes have a diameter in the range of from 0.5-8 mm.

5. The combustion chamber according to claim 4, wherein the venting holes have a diameter in the range of from 2-4 mm.

6. The combustion chamber according to claim 1, wherein the container is made of steel, stainless steel, bronze, brass, iron, cast iron, aluminum, or any alloy thereof, a plastic, or a fibre reinforced resin material.

7. The combustion chamber according to claim 6, wherein the container is made of stainless steel.

8. The combustion chamber according to claim 1, wherein the container has the shape of a cylinder or a frustum of a cone.

9. The combustion chamber according to claim 8, wherein the container has the shape of a cylinder.

10. The combustion chamber according to claim 1, wherein the combustion chamber is of such a construction and design that it withstands operational launching pressures.

11. A launching system for launching a fireworks projectile comprising a launch tube for holding and successively launching the fireworks projectile and a combustion chamber according to claim 1, in which combustion chamber a propellant charge can be loaded.

12. The launching system according to claim 11, wherein the combustion chamber is arranged such that in operation the propellant charge is in direct contact with the top wall of the combustion chamber.

13. The launching system according to claim 11, the launching system further comprising an igniter which can be brought in the proximity of or in contact with the propellant material contained in the propellant charge when said propellant charge is loaded in the combustion chamber.

14. The launching system according to claim 11, wherein the top wall of the combustion chamber is connected to the launch tube.

15. A kit of parts comprising a combustion chamber as defined in claim 1, and a propellant charge for use in the combustion chamber.

16. The kit of parts according to claim 15, the propellant charge comprising a container containing a reduced smoke propellant material, wherein the perforatable disk comprises a closed layer or confinement of a solid material covering a cross-section of the container and arranged in the upper part of the container, wherein the closed layer or confinement is at least partly perforatable or rupturable by gas pressure generated during ignition of the propellant material in the combustion chamber.

17. The kit of parts according to claim 16, wherein the container of the propellant charge comprises a closed layer or confinement of a solid material which covers a horizontal cross-section of the container.

18. The kit of parts according to claim 16, wherein the layer or confinement of solid material in the container of the propellant charge forms an integrated part of said container.

19. The kit of parts according to claim 16, wherein the closed layer or confinement of solid material in the container of the propellant charge is connected to the inner surface of the container, thereby forming the top side of the container.

20. The kit of parts according to claim 16, wherein the closed layer or confinement of the solid material in the container of the propellant charge is attached to the top or bottom side of the container.

21. The kit of parts according to claim 16, wherein the solid material in the container has a predetermined bursting strength.

22. The kit of parts according to claim 15, wherein the container of the propellant charge and the combustion chamber have a cylindrical shape.

23. The kit of parts according to claim 15, wherein the container of the propellant charge has a shape of: a cylinder, frustum of a cone, or a cone, and the container is produced as a cartridge, a pouch, a cup, a shell or a disk.

24. The kit of parts according to claim 16, wherein the layer or confinement of solid material in the container of the propellant charge is symmetrically arranged over a cross-section of the container.

25. The kit of parts according to claim 16, wherein the layer or confinement of solid material in the container of the propellant charge covers a circular part of the cross-section of the container.

26. The kit of parts according to claim 16, wherein the layer or confinement of the solid material in the container of the propellant charge is in the form of a disk.

27. A method for launching a fireworks projectile comprising the steps:

loading a propellant charge into a combustion chamber of a launching system, wherein the combustion chamber is positioned with a launch tube and comprises a top wall with vent holes and a rupture disk, which seals the vent holes, that perforates when a preset pressure is exceeded within the combustion chamber;

closing the combustion chamber;

loading the fireworks projectile into the launch tube adjacent the top wall and the vent holes, and igniting propellant material contained in the propellant charge, thereby causing the fireworks projectile to be launched from the launching system, wherein the propellant material comprises a smokeless powder requiring a predefined high pressure for completion of an ignition stage and wherein the preset pressure is greater than the predefined high pressure.

* * * * *